United States Patent [19]

Bratt et al.

[11] 4,191,019

[45] Mar. 4, 1980

[54] DOUBLE-ACTING HOT GAS ENGINE ASSEMBLAGE

[75] Inventors: Jan C. Bratt, Malmö; Bengt-Oye M. Moodysson, Åkarp; Nils K. G. Rosenqvist, Malmö, all of Sweden

[73] Assignee: Kommanditbolaget United Stirling (Sweden) AB & Co., Malmö, Sweden

[21] Appl. No.: 896,590

[22] Filed: Apr. 14, 1978

[30] Foreign Application Priority Data

Aug. 26, 1977 [GB] United Kingdom ..... 35837/77

[51] Int. Cl.[2] ..... F02G 1/04

[52] U.S. Cl. ..... 60/525; 60/716

[58] Field of Search ..... 60/525, 716; 123/52 A, 123/55 R, 55 A, 197 AC

[56] References Cited

U.S. PATENT DOCUMENTS

| | | | |
|---|---|---|---|
| 2,419,305 | 4/1947 | Woolson | 60/716 |
| 4,020,635 | 5/1977 | Joynes | 60/525 |

*Primary Examiner*—Allen M. Ostrager

*Attorney, Agent, or Firm*—Finnegan, Henderson, Farabow, Garrett & Dunner

[57] ABSTRACT

Hot gas engine units of the type having parallel cylinders in two parallel rows and containing pistons connected to two parallel crank shafts engaging a common third output shaft are juxtaposed into an assemblage of four such units. The output shaft is common to all four units and each of four crank shafts is connected to pistons in cylinders of adjacent rows of neighboring units. In such assemblage the total number of crank shafts in four units is reduced from eight to four and one output shaft will replace four output shafts.

4 Claims, 3 Drawing Figures

DOUBLE-ACTING HOT GAS ENGINE ASSEMBLAGE

This invention relates to a double-acting hot gas engine assemblage.

Hot gas engine assemblages in operation produce little or low noise and vibration, so that such assemblages could be used for improving the environment on ships, and they make it possible to use a combination of a heat source burning fossil fuel and a compressor in a heat pump installation for heating dwelling houses efficiently.

However, it has hitherto been difficult to provide hot gas engine assemblages having power outputs exceeding a few hundred kilowatt.

The present invention is therefore intended to facilitate the provision of a compact double-acting hot gas engine assemblage having a large maximum power output.

According to the present invention a double-acting hot gas engine assemblage comprises in combination a central common power output shaft, four hot gas engine cylinder-and-piston units disposed symmetrically around the axis of the power output shaft, four crank-shafts with axes parallel to the axis of the power output shaft, piston rods-and-cross-heads and connecting rods connecting the pistons in said units to the respective crank-shafts, and gear wheels connecting the crank-shafts to the power output shaft, each of said units including a plurality of cylinders which are parallel to each other.

Preferably each of said units comprises four cylinders and each crank-shaft is connected to two pistons in each of two of said units.

The assemblage may conveniently comprise a common heat source for supplying heat to all the engine working gas charges, and the heat source may be a furnace for burning coal or other solid fuel particles in a fluidised bed.

In one favoured assemblage the power output shaft is vertical and drives an electrical generator which is located above the crank-shafts and the heat source is located below the crank-shafts.

Figure 1:
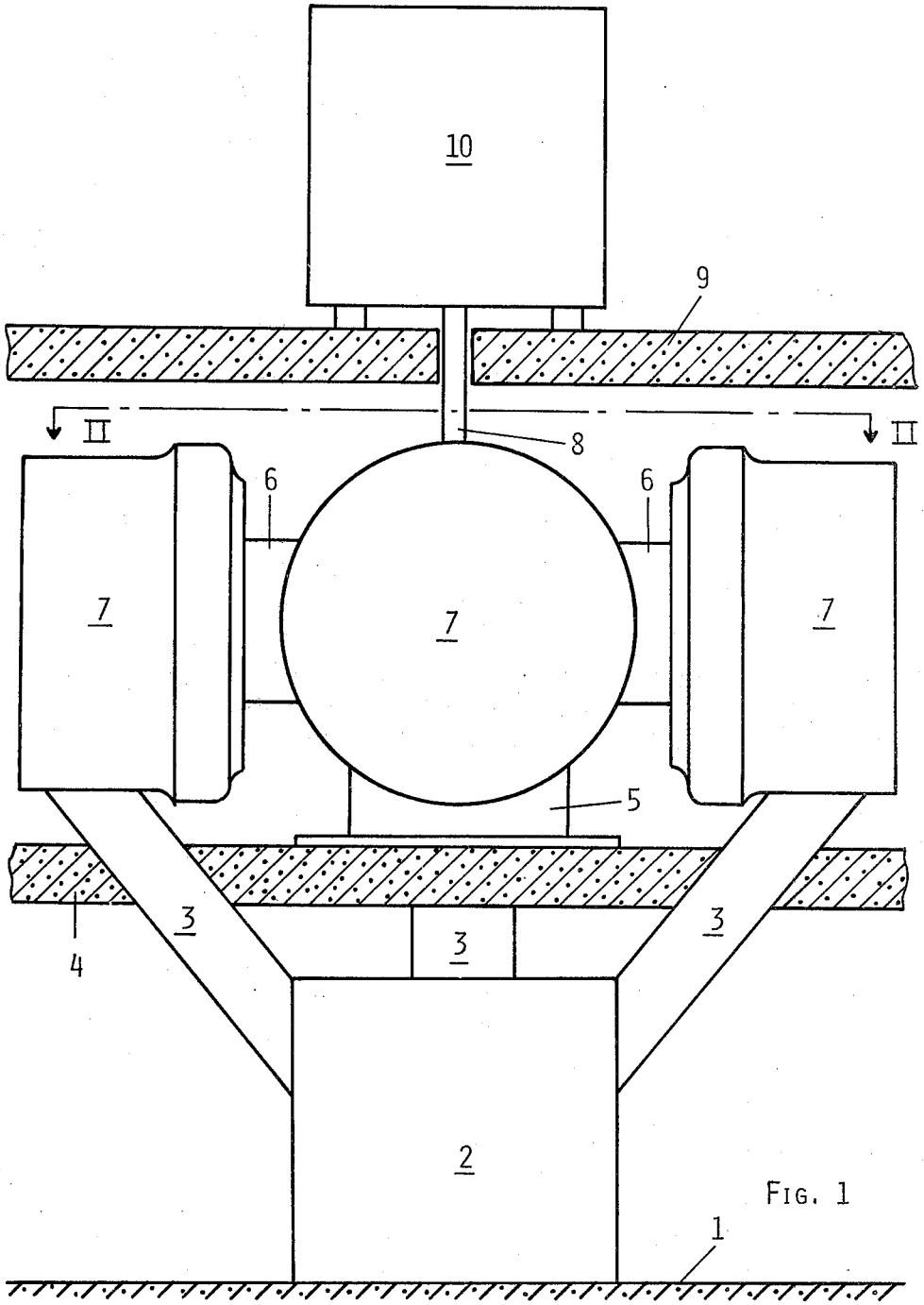
Figure 2:
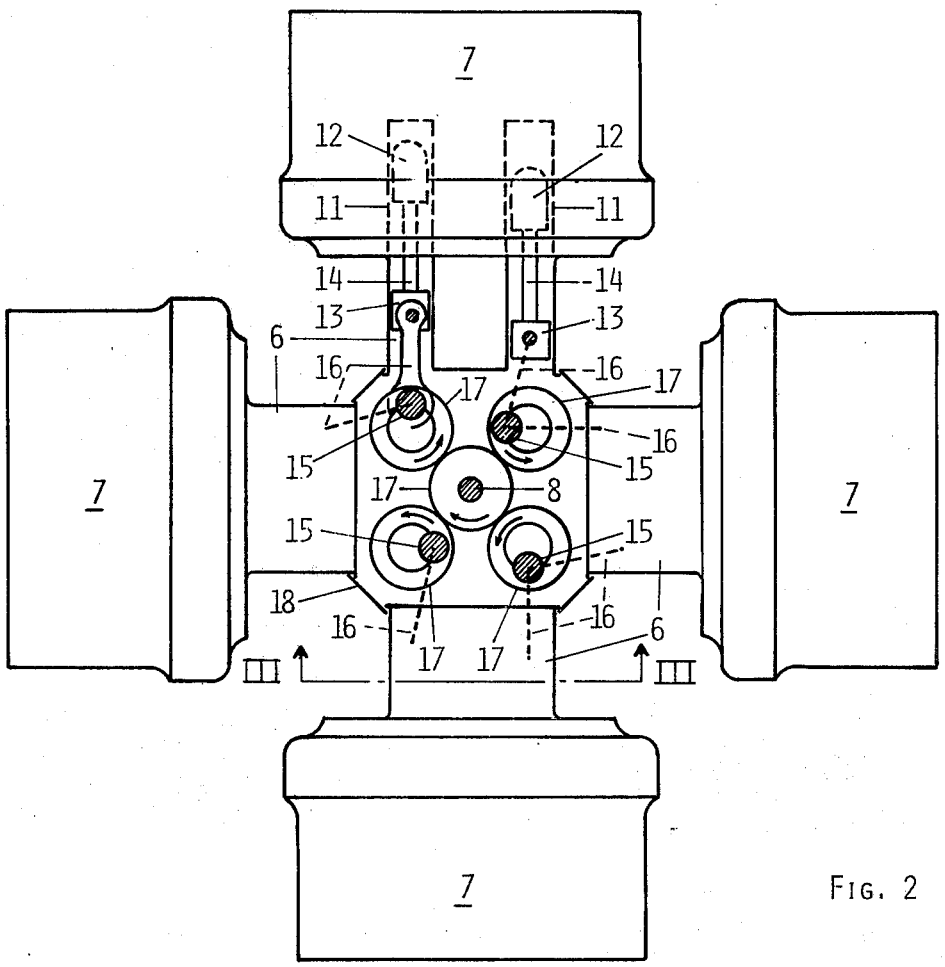
Figure 3:
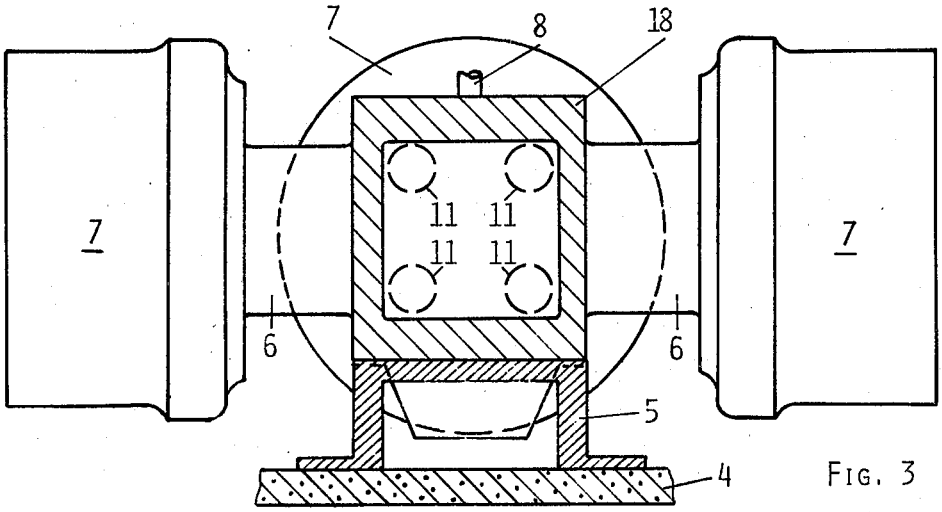

How the invention may be put into practice is described in more detail with reference to the accompanying schematic drawings, in which FIG. 1 is a side view of an assemblage according to the invention, FIG. 2 is a partly sectional view in the direction of the arrows II—II of FIG. 1, and FIG. 3 is a diagrammatic view partly in section in the direction of the arrows III—III of FIG. 2.

The illustrated assemblage is located in a three-storey building with a bottom floor 1 on which is a heat source in the form of a furnace 2 for burning fossil fuel—e.g. coal in a fluidised bed. Heat pipes 3 pass through a floor 4 of the building to heat-exchangers by which heat is transferred to the heater head units (not shown) of four double-acting hot gas engine cylinder-and-piston units 7.

A pedestal 5 is secured to the middle floor 4 to support a crank case 18 shown in FIGS. 2 and 3 which carries four equi-spaced cross-head casings 6—only two of which are shown in FIG. 1. Each cross-head casing 6 carries a hot gas engine cylinder-and-piston unit 7 including heat-exchanger devices in the form of conventional coolers and heat regenerator units (not shown). A power output shaft 8 extends from the crank case 18 and is coupled to a generator 10 located on an upper floor 9 above the engine units 7 and the crank case 18.

As shown in FIGS. 2 and 3, each of the four units 7 contains four parallel cylinders 11 in square formation. Each cylinder 11 contains a respective working piston 12 connected to a respective cross-head 13 via a respective piston rod 14. Each cross-head 13 is connected to a respective one of four crank-shafts 15 by a respective connecting rod 16.

The four crank-shafts 15 and the power output shaft 8 are disposed vertically and are coupled together by gear wheels 17.

Each crank-shaft 15 is connected to four cross-heads 13, of which two are in one cross-head casing 6 and move in a direction perpendicular to that of two other cross-heads located in a neighboring cross-head casing 6 and connected to the same crank-shaft 15.

It will be understood that the illustrated engine assemblage can be completely balanced, and offers a compact 16-cylinder engine assemblage suitable for location in a building. Obviously in addition to or instead of an electrical generator the assemblage can drive a heat pump or supply energy to other energy-consuming plants or apparatus, for example propulsion machinery in a water-bourne or rail vehicle.

What we claim is:

1. A double-acting hot gas engine assemblage comprising in combination a central common power output shaft; four hot gas engine cylinder-and-piston units disposed symmetrically around the axis of the power output shaft, each unit including a plurality of individual cylinders and associated pistons, said cylinders and associated pistons in each of said units being parallel to each other and arranged in two parallel rows; four crank-shafts with axes parallel to and equidistant from the axis of the power output shaft; piston rods, cross-heads and connecting rods connecting the pistons in said units to said crank-shafts, the axes of said crank-shafts lying substantially on the respective intersections of the planes defined by the axes of the cylinders in adjacent ones of said rows in adjacent ones of said units, each of said crank-shafts being connected to those of said pistons associated with said cylinders defining the respective intersecting planes; and gear wheels connecting the crank-shafts to the power output shaft for interdependent rotation.

2. An assemblage according to claim 1, wherein each of said units comprises four cylinders and each crank-shaft is connected to two pistons in each of two of said units.

3. An assemblage according to claim 1 or 2, comprising a common heat source for supplying heat to all the engine working gas charges.

4. An assemblage according to claim 3, wherein the heat source is a furnace for burning coal or other solid fuel particles in a fluidised bed.

* * * * *